US011276508B2

(12) United States Patent
Carney et al.

(10) Patent No.: US 11,276,508 B2
(45) Date of Patent: Mar. 15, 2022

(54) SURROGATE ISOTOPE-CONTAINING MATERIALS FOR EMERGENCY RESPONSE TRAINING AND METHODS OF FORMATION AND DISPERSAL

(71) Applicant: Battelle Energy Alliance, LLC, Idaho Falls, ID (US)

(72) Inventors: Kevin P. Carney, Idaho Falls, ID (US); Martha R. Finck, Ashton, ID (US); Jared J. Horkley, Blackfoot, ID (US); Mathew T. Kinlaw, Idaho Falls, ID (US); Jana K. Pfeiffer, Idaho Falls, ID (US); Erin M. May, Idaho Falls, ID (US); Mathew S. Snow, Idaho Falls, ID (US); Nicholas R. Mann, Idaho Falls, ID (US); Christopher Andrew McGrath, Blackfoot, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 453 days.

(21) Appl. No.: 16/228,465

(22) Filed: Dec. 20, 2018

(65) Prior Publication Data

US 2020/0203032 A1 Jun. 25, 2020

(51) Int. Cl.

| | |
|---|---|
| ***G21G 1/06*** | (2006.01) |
| ***G21G 4/00*** | (2006.01) |
| ***G21G 1/12*** | (2006.01) |
| ***G21H 5/00*** | (2006.01) |
| *G21D 3/04* | (2006.01) |
| *G21C 9/02* | (2006.01) |
| *G21D 3/00* | (2006.01) |
| *G21H 5/02* | (2006.01) |
| *G21G 1/02* | (2006.01) |
| *G21G 4/04* | (2006.01) |
| *G21G 1/00* | (2006.01) |

(52) U.S. Cl.

CPC ..... *G21G 1/06* (2013.01); *G21G 1/12* (2013.01); *G21G 4/00* (2013.01); *G21H 5/00* (2013.01); *G21C 9/02* (2013.01); *G21D 3/002* (2019.01); *G21D 3/04* (2013.01); *G21G 1/02* (2013.01); *G21G 4/04* (2013.01); *G21G 2001/0036* (2013.01); *G21G 2001/0094* (2013.01); *G21H 5/02* (2013.01)

(58) Field of Classification Search

CPC .. G21G 1/06; G21G 4/00; G21G 1/12; G21H 5/00

USPC ..... 376/158, 186, 189

See application file for complete search history.

(56) References Cited

U.S. PATENT DOCUMENTS

| | | | |
|---|---|---|---|
| 4,010,100 | A | 3/1977 | Suslick |
| 4,689,128 | A | 8/1987 | Arisawa et al. |
| 4,943,425 | A | 7/1990 | Su et al. |
| 7,655,935 | B1 | 2/2010 | Frank |
| 8,233,580 | B2 | 7/2012 | Bedeschi |
| 8,679,377 | B2 | 3/2014 | Munro, III et al. |
| 9,239,385 | B2 | 1/2016 | Fawcett et al. |
| 9,443,708 | B2 | 9/2016 | Farmer, III et al. |

OTHER PUBLICATIONS

Carney, "The development of radioactive sample surrogates for training and exercises", Journal of Radioanalytical and Nuclear Chemistry 296, No. 2 (2013): 769-773. (Year: 2013).*

IAEA, Production and Use of Short-Lived Radioisotopes from Reactors vol. I. Proceedings of a Seminar on the Practical Applications of Short-Lived Radioisotopes Produced in Small Research Reactors. (1963) pp. 191-212 and 229-244. (Year: 1963).*

May et al., Photonuclear Production and Chemical Isolation of 237U and Its Photofission Fragments, presentation at the 62nd Radiobioassay and Radiochemical Measurements Conference (RRMC), Honolulu, Hawaii, Feb. 7, 2017, 17 pages.

Idaho National Laboratory, Production of 179Ta Isotopic Standard Through Photonuclear Reaction and High Efficiency Chemical Separations, presentation at the 62nd Radiobioassay and Radiochemical Measurements Conference (RRMC), Honolulu, Hawaii, Feb. 8, 2017, 14 pages.

Edna S. Cárdenas, Production and Isolation of 237U and Fission Fragments Resulting from the 238U(gamma, n) and 238U(gamma, f) Reactions, presentation at the 13th International Topical Meeting on Nuclear Applications of Accelerators, American Nuclear Society, Quebec City, Quebec, Canada, Aug. 1, 2017, 14 pages.

Carney et al.. The Development of Radioactive Sample Surrogates for Training and Exercises, J Radioanal Nucl Chem, Sep. 6, 2012, pp. 769-773, Akadémiai Kiadó, Budapest, Hungary.

Carney et al., The Development of Radioactive Glass Surrogates for Fallout Debris, J Radioanal Nucl Chem, Dec. 4, 2013, pp. 363-372, Akadémiai Kiadó, Budapest, Hungary.

* cited by examiner

*Primary Examiner* — Jack W Keith
*Assistant Examiner* — Daniel Wasil
(74) *Attorney, Agent, or Firm* — TraskBritt

(57) ABSTRACT

Surrogate materials are in the form of solid particles that include surrogate isotopes, namely, short-lived isotopes selected and formed to serve as surrogates for the radioactive materials of a nuclear fallout without including isotopes that are, or that decay to, biologically or environmentally deleterious and persistent isotopes. The surrogate material may be formed using high-purity reactant material and irradiation and separation techniques that enable tailoring of the isotopes and ratios thereof included in the surrogate material, and the surrogate material may be dispersed, e.g., in a training environment, in solid form.

16 Claims, No Drawings

SURROGATE ISOTOPE-CONTAINING MATERIALS FOR EMERGENCY RESPONSE TRAINING AND METHODS OF FORMATION AND DISPERSAL

STATEMENT REGARDING FEDERALLY SPONSORED RESEARCH OR DEVELOPMENT

This invention was made with government support under Contract Number DE-AC07-05-ID14517 awarded by the United States Department of Energy. The government has certain rights in the invention.

FIELD

The disclosure, in various embodiments, relates generally to radioactive isotopes useful for emergency response training. More particularly, this disclosure relates to surrogate isotopes that exhibit characteristics similar to that of radioactive isotopes expected to be encountered in the aftermath of nuclear events, but which surrogate isotopes have shorter half-lives and are environmentally nontoxic.

BACKGROUND

The emergency response community trains to be prepared for disaster situations, such as those that might involve the dispersal of radioactive material. Training with actual radioactive material can be problematic from a safety and environmental standpoint. For improved safety, efforts have been made to develop materials that may be used in place of actual radioactive material employed, for example, in nuclear reactors and weapons, and yet allow trainers to use real-world methods and equipment configured for detecting such actual radioactive material. Successful stand-in (or "surrogate") materials preferably exhibit the same or similar radioactive emissions and chemical dispersion properties as the actual radioactive material for which the training is undertaken. Developing surrogate materials that exhibit the appropriate properties but are relatively safe has, and continues to, present challenges.

Even radioactive material used in industrial applications may not be suitable for nuclear fallout scenario training. For example, industrially-used, radioactive metals and alloys (e.g., $^{60}$Co, $^{75}$Se, $^{192}$Ir), oxides (e.g., $^{241}$Am, $^{238}$Pu), salts (e.g., $^{137}$Cs (e.g., in CsCl), $^{90}$Sr (e.g., in $SrF_2$)), and other materials that may be encased in ceramics or glasses (e.g., $^{137}$Cs) may have long half-lives of tens of years or greater and may be considered environmentally and biologically persistent and radio-toxic. They also have differing radioactive decay paths and, thus, different particle emissions (alpha ($\alpha$), beta ($\beta$), and gamma ($\gamma$)). These properties may prohibit the use of these materials in training, unless the materials are in sealed sources. However, using sealed sources is not conducive for training for nuclear events with large-area distributions of radioactive material or for developing and testing technologies to be used in large-area contaminated environments.

Efforts have been made to simulate radioactive environments, such as for emergency response training purposes, with isotopes having relatively short half-lives. For example, isotopes such $^{99}$Mo and $^{67}$Ga have been used to contaminate environments and then collected to assess environmental sampling and characterization techniques. Conventionally, these isotopes have been distributed in solutions or otherwise as liquids. However, liquids tend to become absorbed into soils and porous surfaces, which can prohibit accurate sampling of solely the source material, introducing artifact into the sampling data.

Other efforts have involved using activated KBr as a surrogate for the sources of cesium isotopes (e.g., $^{137}$Cs), or strontium isotopes (e.g., $^{90}$Sr), which are isotopes of particular importance to the nuclear forensics community. The chemical forms of these isotopes are often the forms of pressed salt pellets (e.g., CsCl), glass silicates (e.g., cesium silicate ($Cs_2SiO_3$), strontium silicate ($SrSiO_3$)), or as ceramics (e.g., cesium pollucite ($Cs_2Al_2Si_4O_{12}\cdot 12H_2O$), strontium titanate ($SrTiO_3$)). As a surrogate for these, salt and glass/ceramic forms of neutron activated KBr have been developed and have been dispersed at training facilities as solutions. The solutions also tend to become absorbed into absorbent items in the training environment, hindering close emulation of real-world nuclear disaster environments.

Despite the advances made to date, developing appropriate surrogate materials and formation and dispersal methods therefor continues to present a challenge.

BRIEF SUMMARY

Disclosed is a surrogate material for emulating nuclear fallout debris. The surrogate material comprises solid particles comprising at least one surrogate isotope exhibiting a half-life of less than about three days. The at least one surrogate isotope is selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99.

Also disclosed is a method for dispersing a surrogate material for nuclear fallout training. The method comprises providing a surrogate material comprising solid particles comprising at least one surrogate isotope exhibiting a half-life of less than about three days, the at least one surrogate isotope selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99. And, the method comprises dispersing the solid particles of the surrogate material at a training facility.

Additionally, disclosed is a method for forming a surrogate material for emulating nuclear fallout debris. The method comprises irradiating a high-purity reactant material by neutron irradiation or Bremsstrahlung irradiation to form solid particles comprising at least one surrogate isotope selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99.

DETAILED DESCRIPTION

Surrogate materials, according to embodiments of the disclosure, are in the form of solid particles that include surrogate isotopes, namely, short-lived isotopes formed and selected to serve as surrogates for the radioactive materials of a nuclear fallout without including isotopes that are, or that decay to, biologically or environmentally deleterious and persistent isotopes. The surrogate isotopes can be incorporated into a matrix material (e.g., ceramic or glass material) while still emulating the behavior of desired emulated material. Such surrogate isotopes can be produced, directly, by irradiation or produced using isotopes that are chemically purified and combined, post-irradiation, in desired ratios and activities. Thus, the surrogate materials may have high radio-isotopic purity, and they may be dispersed, e.g., in a training environment, in solid form. Embodiments of the disclosure also include methods of forming the surrogate isotopes, such as by irradiation and chemical purification methods, and methods for distributing the surrogate isotopes, such as for training.

As used herein, the term "surrogate," when referring to an isotope or material, means and includes an isotope or material that exhibits the same or similar particular characteristics compared to those particular characteristics exhibited by an isotope or material to be emulated, i.e., by an "emulated" isotope or "emulated" material. Not all characteristics will be exhibited in the same or similar manner. For example, it is expected that a "surrogate" isotope will exhibit a much shorter half-life compared to that exhibited by the isotope to be emulated.

As used herein, the term "short-lived," when referring to an isotope, refers to an isotope with a half-life of less than three days (e.g., less than seventy-two hours), e.g., less than about two-and-a-half days (e.g., less than about sixty hours), e.g., less than about two days (e.g., less than about forty-eight hours).

As used herein, the term "short half-life" refers to a half-life of less than three days (e.g., less than seventy-two hours), e.g., less than about two-and-a-half days (e.g., less than about sixty hours), e.g., less than about two days (e.g., less than about forty-eight hours).

As used herein, the term "long half-life" refers to a half-life of greater than a short half-life, e.g., greater than about two days (e.g., greater than about forty-eight hours), e.g., greater than about two-and-a-half days (e.g., greater than about sixty hours), e.g., greater than three days (e.g., greater than seventy-two hours).

As used herein, the term "high-purity," when referring to a material, refers to that material comprising at least 99 at. % (e.g., at least 99.9 at. %) of the element or compound in question.

As used herein, the term "reactant material" refers to a material to be subjected to irradiation to form surrogate isotopes.

As used herein, the terms "about" and "approximately," when either is used in reference to a numerical value for a particular parameter, are inclusive of the numerical value and a degree of variance from the numerical value that one of ordinary skill in the art would understand is within acceptable tolerances for the particular parameter. For example, "about" or "approximately," in reference to a numerical value, may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the terms "comprises," "comprising," "includes," and/or "including" specify the presence of stated materials, elements, and/or isotopes, but do not preclude the presence or addition of one or more other materials, elements, and/or isotopes thereof.

As used herein, "and/or" includes any and all combinations of one or more of the associated listed items.

As used herein, the singular forms "a," "an," and "the" are intended to include the plural forms as well, unless the context clearly indicates otherwise.

The following description provides specific details, such as material types and processing conditions, in order to provide a thorough description of embodiments of the disclosed materials and methods. However, a person of ordinary skill in the art will understand that the embodiments of the materials and methods may be practiced without employing these specific details. Indeed, the embodiments of the materials and methods may be practiced in conjunction with conventional techniques employed in the industry.

The processes described herein do not form a complete process flow for the related methods. The remainder of the methods are known to those of ordinary skill in the art. Accordingly, only the methods and conditions necessary to understand embodiments of the present materials and methods are described herein.

Surrogate materials, according to embodiments of the present disclosure have short half-lives; decay to stable or short-lived daughter isotopes that decay to stable, non-toxic isotopes; can be prepared in a manner that produces high-purity materials, so that deleterious radioactive isotopes may be avoided; and that emulate specific properties (e.g., physical and chemical properties) of radioactive materials of interest.

The surrogate materials may include one or more of the following surrogate isotopes: potassium-42 (K-42) ($^{42}$K), bromine-82 (Br-82) ($^{82}$Br), scandium-44 (Sc-44) ($^{44}$Sc), scandium-44m (Sc-44m) ($^{44m}$Sc), copper-64 (Cu-64) ($^{64}$Cu), barium-140 (Ba-140) ($^{140}$Ba), lanthanum-140 (La-140) ($^{140}$La), zirconium-95 (Zr-95) ($^{95}$Zr), zirconium-97 (Zr-97) ($^{97}$Zr), tellurium-132 (Te-132) ($^{132}$Te), dysprosium-166 (Dy-166) ($^{166}$Dy), holmium-166 (Ho-166) ($^{166}$Ho), or molybdenum-99 (Mo-99) ($^{99}$Mo). Surrogate isotopes, such as the $^{42}$K and $^{82}$Br, may be formed by neutron irradiation of a high-purity salt; while others of the surrogate isotopes may be formed by Bremsstrahlung irradiation (which may be otherwise known in the art as "braking radiation" or "deceleration radiation"). Such production methods may avoid the production of undesirable isotopes, such as those with long half-lives.

In these or other embodiments, the surrogate isotopes may be formed using neutron- or photon-induced fission or photonuclear induced reactions (i.e., ($\gamma$, $X_n$) and ($\gamma$, $X_p$) reactions, wherein "$\gamma$" indicates incident gamma rays and "X" indicates a number of neutrons ($_n$) or protons ($_p$) emitted from the parent isotope in the photonuclear reaction). With these methods, the desired, short-lived surrogate isotopes may be obtained at high-purity levels.

In some embodiments, the surrogate isotopes may be purified and individually mixed into an encapsulating matrix material (e.g., high-purity silica glass). Such encapsulation in a glass matrix material may be carried out using known sol-gel synthesis techniques. See, e.g., Carney et al., "The Development of Radioactive Sample Surrogates for Training and Exercises," Journal of Radioanalytical and Nuclear Chemistry, (2013), 296:769-773; and Carney et al., "The Development of Radioactive Glass Surrogates for Fallout Debris," Journal of Radioanalytical and Nuclear Chemistry, (2014), 299:363-372, the disclosure of each of which is hereby incorporated herein in its entirety by this reference.

In other embodiments, the surrogate isotopes may be formed as salts that are not encapsulated.

Forming the surrogate materials to be in solid particle form (whether encapsulated or not encapsulated) also enables control of the particle size of the solid surrogate material. In some embodiments, the surrogate material may be formed within particle sizes that range from micron diameters to millimeters in diameter. The particle size of the surrogate material may be controlled, e.g., by controlling particle size during glass formation, and/or by mechanical grinding and/or mechanical sieving of solid glass particles, to further tailor the surrogate material's physical size properties prior to dispersal.

Whether encapsulated or not, the surrogate materials of the disclosure may be dispersed in solid form to emulate nuclear fallout. The ability to disperse the surrogate material as a solid enables the material to be readily re-suspended, and it may adhere to items more effectively than previous materials dispersed as liquids or in solution sprays. So, the solid form dispersal may improve the realism of the training scenarios, such as for decontamination and contamination control training scenarios.

The surrogate material may be free of radioactive isotopes with long half-lives, such as strontium-90 (Sr-90) ($^{90}$Sr) and cesium-137 (Cs-137) ($^{137}$Cs). Yet, the surrogate material may exhibit certain properties similar to those of $^{90}$Sr and/or $^{137}$Cs so the surrogate materials can be used in training to detect the presence of these emulated radioisotopes. These similar properties may be similar radioactive particle and photo emission properties as well as other similar chemical and physical properties of the emulated radioisotopes.

In some embodiments, neutron irradiation may be used to form the surrogate isotopes, such as where neutron irradiation does not form unwanted isotopes (e.g., isotopes with long half-lives and isotopes that are or decay to isotopes that are biologically or environmentally persistent).

In some embodiments, Bremsstrahlung irradiation may be used to form the surrogate isotopes.

Surrogate materials, when dispersed, may comprise a tailored mixture of selected surrogate isotopes. So, any or all of the surrogate isotopes described herein may be selected and included in the surrogate materials used for training.

Surrogate Materials Comprising Activated KBr Salt as Source for Surrogate Isotopes Emulating $^{137}$Cs:

Radioactive cesium-137 (Cs-137) ($^{137}$Cs) is a radioactive, gamma-emitting isotope that those training for nuclear disaster situations wish to be able to detect in contaminated areas. In industrial uses, $^{137}$Cs may be found in glass (cesium silicate ($Cs_2SiO_3$)) or ceramic (cesium pollucite ($Cs_2Al_2Si_4O_{12}\cdot 12H_2O$)) sources, but is most commonly found from a water soluble chloride salt (CsCl) source.

With regard to the common cesium chloride salt, its specific gravity is 3.99 g/cm$^3$, and its melting and boiling points are 919K and 1570K, respectively. The salt is hydroscopic. These properties may be emulated by potassium bromide (KBr) salt, which has similar water solubility and hygroscopic properties. KBr salt's specific gravity is lower, at 2.75 g/cm$^3$, and its melting point and boiling point are higher, at 1346K and 2615K, respectively.

According to some embodiments of the disclosure, surrogate materials may comprise, as surrogate isotopes, isotopes from an irradiated KBr source (e.g., activated KBr salt), so as to be formulated to emulate $^{137}$Cs. The surrogate material, however, may be free of such cesium isotopes and cesium sources.

The surrogate isotopes of the surrogate materials may comprise at least one potassium isotope and/or at least one bromine isotope. Such at least one potassium isotope may be any of potassium-40 (K-40) ($^{40}$K), potassium-41 (K-41) ($^{41}$K), or potassium-42 (K-42) ($^{42}$K). Such at least one bromine isotope may be any of bromine-81 (Br-81) ($^{81}$Br), or bromine-82 (Br-82) ($^{82}$Br).

The natural isotopic abundance of potassium-39 (K-39) ($^{39}$K) is 93.25% and has a thermal neutron capture cross section of 2.1 barns. $^{40}$K is naturally abundant. $^{41}$K also has high abundance, and it has a thermal neutron capture cross section of 1.46 barns. $^{42}$K has a short half-life of about twelve hours. Therefore, in embodiments in which the surrogate material comprises activated KBr as the surrogate isotope source, the potassium isotope composition may be primarily $^{42}$K.

Bromine has two isotopes that may be activated. Namely, naturally occurring isotopes bromine-79 (Br-79) ($^{79}$Br) and bromine-81 (Br-81) ($^{81}$Br) may be activated (e.g., by (n, γ) reactions) to form the radioisotopes bromine-80 (Br-80) ($^{80}$Br) and bromine-82 (Br-82) ($^{82}$Br). $^{80}$Br is an isotope with an extremely short half-life: the metastable state of $^{80}$Br has a half-life of approximately 4.4 hours, and the ground state has a half-life of approximately 17.7 minutes. On the other hand, $^{82}$Br has a half-life of about thirty-five hours, which is a sufficiently long, though short, half-life for use as a surrogate isotope for training purposes. $^{82}$Br exhibits complex gamma emission lines, with an average gamma emission decay energy of about 800 keV, which is similar to the gamma emission energy of $^{137}$Cs, i.e., 661 keV. Therefore, in embodiments in which the surrogate material comprises activated KBr as the surrogate isotope source, the bromine isotope composition may be primarily $^{82}$Br.

Thus, surrogate materials of embodiments of the disclosure may be formed to comprise surrogate isotopes from activated KBr source, formed by neutron irradiation of high-purity KBr salt, as discussed further herein. The neutron irradiation of such high-purity KBr salts have not been observed to result in long half-life isotopes or other contaminates that are environmentally deleterious. The decay daughters of such activated KBr may be stable calcium (Ca) and stable argon (Ar) gas; therefore, the surrogate material may be suitable for use in either outdoor or indoor training facilities without lasting biological or environmental toxicity.

The activated KBr of the surrogate material may be formed by subjecting to neutron irradiation a target KBr salt that is at least 99.9999 at. % pure KBr (i.e., a "highly-pure KBr salt"). Vials (e.g., polyethylene vials) may be cleaned to remove contaminants. For example, the vials may be cleaned with high-purity ethanol to remove grease. Additionally or alternatively, the vials may be cleaned using high-purity optima grade solvents and acids (e.g., nitric acid) to remove other contaminants, such as metallic and salt contaminants, followed by an optima grade water and ethanol solvent rinse.

Once the vials are clean, the high-purity KBr salt may be added, and the vials encased in in an outer polypropylene rabbit already cleaned using the same cleaning procedure used for the vials. The polypropylene rabbit and the sample therein may be suspended, using a non-fluorinated monofilament line, in a dry irradiation tube. The suspension prohibits the vial from contacting the base of the irradiation tube.

The sample, within the polypropylene rabbit, may then be subjected to the neutron irradiation in the dry irradiation tube. Irradiation times may be selected based on the desired radioactivity and reactor power. For example, the irradiation times may be relatively short (e.g., less than fifteen minutes). The neutron irradiation may produce the aforementioned radioactive isotopes of KBr, which may emit beta and gamma radiation.

After irradiation, the material may be cooled for a minimum of fifteen minutes and then withdrawn from the dry irradiation tube and inserted into a shield container to limit exposure of the reactor operator and other personnel to radioactivity.

In other embodiments, aluminum (Al) tubes may be used in place of the polyethylene rabbits and/or a wet irradiation tube may be used in place of the dry irradiation tube.

Once irradiated, the surrogate material—which may be comprise, consist essentially of, or consist of activated KBr with any of the aforementioned surrogate isotopes—may be transported to a training sight using standard radioactive shipping techniques and then dispersed in solid form as the activated KBr salt.

The half-life of the bromine isotope with the longest half-life is bromium-82 (Br-82) ($^{82}$Br), which half-life is still a short half-life of about thirty-five hours. With such a half-life, surrogate materials comprising activated KBr have sufficient half-lives to permit time for the activated KBr salt to be surveyed for radioactive contamination and subjected to gamma spectrometry to ensure desired purity levels before being transported to a training area, dispersed there, and used for training.

Though, in some embodiments, the surrogate material to be dispersed and used for training may comprise activated KBr salt not encapsulated in a matrix material, in other embodiments, the activated KBr salt may be encapsulated in a matrix material (e.g., glass) after neutron irradiation and prior to transport and dispersal. The matrix material may be a glass matrix synthesized using a sol-gel technique, as known in the art. The particle size of the resulting glass-encapsulating particles may be tailored, in size (e.g., by grinding) and density, to be similar to other glasses used in radioactive sources.

Surrogate Materials Comprising $^{44}$Sc and $^{44m}$Sc Surrogate Isotopes:

The isotopes scandium-44 (Sc-44) ($^{44}$Sc) and scandium-44m (Sc-44m) ($^{44m}$Sc) are useful for emulating fine, glass-like nuclear fallout debris. According to embodiments of the disclosure, surrogate material may be prepared to include $^{44}$Sc and $^{44m}$Sc surrogate isotopes. The surrogate material may be prepared by encapsulating scandium-45 (Sc-45) ($^{45}$Sc) (e.g., a high-purity scandium-45 material) in high-purity silica glass via a sol-gel synthesis technique, forming solid particles of glass containing the $^{45}$Sc. Once encapsulated, the glass particles with the $^{45}$Sc may be irradiated using Bremsstrahlung irradiation, e.g., with high-energy Bremsstrahlung photons. The Bremsstrahlung irradiation may produce the $^{44}$Sc and $^{44m}$Sc surrogate isotopes, via a ($\gamma$, n) reaction, already encased in the glass. In the irradiated glass particles, the predominant surrogate isotope may be $^{44m}$Sc, a meta-stable isotope with a short half-life of 2.4 days that decays to stable calcium-44 (Ca-44) ($^{44}$Ca).

As with aforementioned methods of making surrogate materials, high-purity reactant materials (i.e., the $^{45}$Sc initially encapsulated in glass) are used to avoid including isotopes that do not have short half-lives or that are biologically or environmentally toxic. And, the particle size of the glass particles may be controlled during the sol-gel technique or thereafter, e.g., by mechanical grinding and/or sieving. The irradiated glass particles, comprising the $^{44}$Sc and $^{44m}$Sc surrogate isotopes, may then be shipped to and dispersed at a training environment to emulate fallout debris.

Surrogate Materials Comprising Other Bremsstrahlung Irradiation Produced Surrogate Isotopes Encapsulated in Glass Particles:

Bremsstrahlung irradiation may also be used to prepare other surrogate isotopes to be encapsulated in sol-gel glass to form surrogate materials that are alpha-emitting and/or gamma-emitting and dispersible for training scenarios. For example, high-purity reactant materials may be used such as materials with high-purity amounts of uranium (e.g., uranium-238 (U-238) ($^{238}$U)), thorium (Th), and/or actinium (Ac). The high-purity reactant material may be irradiated using Bremsstrahlung irradiation to yield fission products such as, for example and without limitation, strontium-90 (Sr-90) ($^{90}$Sr), californium-252 (Cf-252) ($^{252}$Cf), uranium isotopes, lanthanum-140 (La-140) ($^{140}$-La), barium-140 (Ba-140) ($^{140}$Ba), tellurium-132 (Te-132) ($^{132}$Te), molybdenum-99 (Mo-99) ($^{99}$Mo), zirconium-95 (Zr-95) ($^{95}$Zr), zirconium-97 (Zr-97) ($^{97}$Zr), dysprosium-166 (Dy-166) ($^{166}$Dy), holmium-166 (Ho-166) ($^{166}$Ho), copper-64 (Cu-64) ($^{64}$Cu), neodymium-147 (Nd-147) ($^{147}$Nd), cerium-141 (Ce-141)($^{141}$Ce), and/or cerium-143 (Ce-143) ($^{143}$Ce). Some of these fission products may result from the spontaneous fission of the aforementioned $^{252}$Cf, as well.

After the Bremsstrahlung irradiation, radio-toxic and long-lived fission products, such as the $^{90}$Sr and uranium isotopes are removed from the other fission products using resins (e.g., EICHROM® resins) selective for such elements. Remaining fission products—which may consist essentially of or consist of fission products exhibiting short half-lives—can be separated, elementally, using a series of solid phase group extractions followed by chromatographic separation. With the extractions and separations, desired surrogate isotopes (i.e., isotopes with short half-lives and with stable or non-deleterious decay daughters) are separated at high-purity levels. Such desired surrogate isotopes, so separated, may include one or more of the $^{64}$Cu, $^{140}$Ba, $^{140}$La, $^{95}$Zr, $^{97}$Zr, $^{132}$Te, $^{166}$Dy, $^{166}$Ho, or $^{99}$Mo.

After the separation, select amounts and ratios of the desired surrogate isotopes may then be selected and encapsulated in sol-gel glass, using the aforementioned known sol-gel synthesis techniques, to provide surrogate materials in solid particle form having compositions tailored to different desired element and fission product ratios.

In some embodiments, the glass particles of the surrogate material may comprise more than one of the surrogate isotopes at a desired ratio within the glass particles. For example, some or all of the glass particles may each comprise X at. % (or X wt. % ) $^{140}$La and Y at. % (or Y wt. % ) $^{140}$Ba to exhibit a surrogate material in the form of glass particles exhibiting a ratio of $^{140}$La to $^{140}$Ba of X:Y. Additional or alternative surrogate isotopes may be selected and encapsulated in the sol-gel glass in a similar manner to tailor the ratio of surrogate isotopes within the glass particles.

In other embodiments, each glass particle may encapsulate a particular surrogate isotope, and the various glass particles may be selected and collected together in desired ratios to provide a surrogate material of solid particle glass form. For example, after irradiation and separation, the $^{140}$La may be encapsulated in sol-gel glass without other surrogate isotopes present; and the $^{140}$Ba may be encapsulated in sol-gel glass without other surrogate isotopes present. X amount (e.g., by weight) of the $^{140}$La-encapsulated glass particles may be collected together with Y amount (e.g., by weight) of the $^{140}$Ba-encpasulated glass particles to form a surrogate material in the form of a mixture of glass particles exhibiting a ratio of $^{140}$La to $^{140}$Ba of X:Y.

In still other embodiment, some glass particles of the surrogate material may encapsulate a select one or more surrogate isotopes while other glass particles of the surrogate material may encapsulate other select one or more surrogate isotopes. Nonetheless, the resulting surrogate material is in the form of a mixture of solid glass particles with select surrogate isotopes and select ratios thereof.

In some embodiments, the surrogate material may be tailored to include surrogate isotopes irradiated by different methods. For example, the surrogate material may include some amount of solid material with surrogate isotopes irradiated by neutron irradiation and another amount of solid material with surrogate isotopes irradiated by Bremsstrahlung irradiation. Thus, a surrogate material may comprise a mixture of a select amount of activated KBr salt particles (comprising $^{42}$K and/or $^{82}$Br surrogate isotopes) and a select amount of glass particles encapsulating other surrogate isotopes (e.g., $^{44}$Sc, $^{44m}$Sc, $^{64}$Cu, $^{140}$Ba, $^{140}$La, $^{95}$Zr, $^{97}$Zr, $^{132}$Te, $^{161}$Dy, $^{161}$Ho, and/or $^{99}$Mo). Such surrogate material therefore comprises a mixture of solid particles comprising surrogate isotopes, which solid particles may then be dispersed (e.g., dusted, exploded, spread) in solid form at training facilities where the surrogate isotopes emulate characteristics of isotopes that would be expected to be in nuclear fallout debris.

Accordingly, disclosed is a surrogate material for emulating nuclear fallout debris. The surrogate material comprises solid particles comprising at least one surrogate isotope exhibiting a half-life of less than about three days. The at least one surrogate isotope is selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99.

Additionally, disclosed is a method for forming a surrogate material for emulating nuclear fallout debris. The method comprises irradiating a high-purity reactant material by neutron irradiation or Bremsstrahlung irradiation to form solid particles comprising at least one surrogate isotope selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99.

Because of the selection of isotopes with short half-lives for the surrogate isotopes included in the surrogate material and the use of high-purity reactant materials and irradiation and separation techniques that maintain high-purity, undesirable isotopes (e.g., those with long half-lives) may not be present in the surrogate material, even once the surrogate isotopes of the surrogate material decay. Thus, the solid particle surrogate material may be tailored to emit alpha and/or gamma radiation to emulate particular desired fallout debris materials and may be shipped to and dispersed at training facilities (e.g., indoor facilities, outdoor facilities) without long-lasting biological and environmental negative effects.

Further, because the surrogate material is in solid particle form and prepared by methods that enable control of the particle size, the solid particles of the surrogate material may be readily dispersed (e.g., dusted, exploded, spread) in solid form, e.g., without being included in a liquid or solution for dispersal. The solid particles are therefore readily re-suspendable and may not absorb into porous surfaces as readily as they would be if dispersed in liquid or solution form. As solid particles, the surrogate material may also adhere to items at a training facility more effectively than conventional surrogate materials dispersed in the form of liquids or solution sprays. Thus, the solid particle form of the surrogate material may better emulate nuclear fallout debris than conventional, liquid- or solution-form surrogate materials.

Accordingly, disclosed is a method for dispersing a surrogate material for nuclear fallout training. The method comprises providing a surrogate material comprising solid particles comprising at least one surrogate isotope exhibiting a half-life of less than about three days, the at least one surrogate isotope selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99. And, the method comprises dispersing the solid particles of the surrogate material at a training facility.

While the disclosed materials and methods are susceptible to various modifications and alternative forms in implementation thereof, specific embodiments have been described in detail herein. However, it should be understood that the present invention is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. A surrogate material for emulating nuclear fallout debris, the surrogate material comprising:

solid particles comprising at least one surrogate isotope exhibiting a half-life of less than about three days, the at least one surrogate isotope selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99, wherein at least some of the solid particles are not encapsulated in another material and comprise activated potassium bromide (KBr) salt particles comprising at least one of the potassium-42 or the bromine-82; and wherein at least some others of the solid particles comprise a matrix material encapsulating at least one other surrogate isotope, the at least one other surrogate isotope selected from the group consisting of the scandium-44, the scandium-44m, the copper-64, the barium-140, the lanthanum-140, the zirconium-95, the zirconium-97, the tellurium-132, the dysprosium-166, the holmium-166, and the molybdenum-99.

2. The surrogate material of claim 1, wherein the matrix material is silica glass.

3. The surrogate material of claim 1, wherein at least a portion of the at least some others of the solid particles each comprise only one surrogate isotope selected from the group consisting of the scandium-44, the scandium-44m, the copper-64, the barium-140, the lanthanum-140, the zirconium-95, the zirconium-97, the tellurium-132, the dysprosium-166, the holmium-166, and the molybdenum-99.

4. The surrogate material of claim 3, wherein at least another portion of the at least some others of the solid particles each comprise at least one other surrogate isotope selected from the group consisting of the scandium-44, the scandium-44m, the copper-64, the barium-140, the lanthanum-140, the zirconium-95, the zirconium-97, the tellurium-132, the dysprosium-166, the holmium-166, and the molybdenum-99.

5. The surrogate material of claim 1, wherein the at least one surrogate isotope exhibits a half-life of less than two days.

6. The surrogate material of claim 1, wherein the surrogate material is free of isotopes with half-lives greater than three days.

7. A method for dispersing a surrogate material for nuclear fallout training, the method comprising:

providing a surrogate material comprising solid particles comprising at least one surrogate isotope exhibiting a half-life of less than about three days, the at least one surrogate isotope selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum 99; and dispersing the solid particles of the surrogate material at a training facility, wherein at least some of the solid particles are not encapsulated in another material and comprise activated potassium bromide (KBr) salt particles comprising at least one of the potassium-42 or the bromine-82, and wherein at least some others of the solid particles comprise a matrix material encapsulating at least one other surrogate isotope, the at least one other surrogate isotope selected from the group consisting of the scandium-44, the scandium-44m, the copper-64, the barium-140, the lanthanum-140, the zirconium-95, the zirconium-97, the tellurium-132, the dysprosium-166, the holmium-166, and the molybdenum-99.

8. The method of claim 7, wherein dispersing the solid particles of the surrogate material at a training facility comprises dispersing the solid particles without adding a liquid or solution to the surrogate material.

9. A method for forming a surrogate material for emulating nuclear fallout debris, the method comprising irradiating a high-purity reactant material by neutron irradiation or Bremsstrahlung irradiation to form the surrogate material comprising solid particles comprising at least one surrogate isotope exhibiting a half-life of less than about three days, the at least one surrogate isotope selected from the group consisting of potassium-42, bromine-82, scandium-44, scandium-44m, copper-64, barium-140, lanthanum-140, zirconium-95, zirconium-97, tellurium-132, dysprosium-166, holmium-166, and molybdenum-99, wherein at least some of the solid particles are not encapsulated in another material and comprise activated potassium bromide (KBr) salt particles comprising at least one of the potassium-42 or the bromine-82, and wherein at least some others of the solid particles comprise a matrix material encapsulating at least one other surrogate isotope, the at least one other surrogate isotope selected from the group consisting of the scandium-44, the scandium-44m, the copper-64, the barium-140, the lanthanum-140, the zirconium-95, the zirconium-97, the tellurium-132, the dysprosium-166, the holmium-166, and the molybdenum-99.

10. The method of claim 9, wherein the method comprises irradiating a high-purity potassium bromide (KBr) salt by the neutron irradiation to form the activated KBr salt particles comprising the at least one of the potassium-42 or the bromine-82.

11. The method of claim 9, wherein the method comprises irradiating high-purity scandium-45 material by the Bremsstrahlung irradiation to form the at least some others of the solid particles comprising at least one of the scandium-44 or the scandium-44m.

12. The method of claim 11, wherein the method comprises, before irradiating the high-purity scandium-45 material, encapsulating the high-purity scandium-45 material in the matrix material, the matrix material comprising glass.

13. The method of claim 9, wherein the high-purity reactant material comprises:

a KBr salt from which the at least some of the solid particles are formed; and at least one of uranium, thorium, or actinium, from which the at least some others of the solid particles are formed.

14. The method of claim 13, wherein the method comprises:

irradiating the at least one of the uranium, the thorium, or the actinium by the Bremsstrahlung irradiation to form fission products;

removing from the fission products isotopes with half-lives of greater than three days, leaving fission products exhibiting short half-lives;

separating, from the fission products exhibiting the short half-lives, at least one Bremsstrahlung-irradiation-derived surrogate isotope to provide the at least one other surrogate isotope, the at least one Bremsstrahlung-irradiation-derived surrogate isotope being selected from the group consisting of the copper-64, the barium-140, the lanthanum-140, the zirconium-95, the zirconium-97, the tellurium-132, the dysprosium-166, the holmium-166, and the molybdenum-99; and after the separating, encapsulating the at least one Bremsstrahlung-irradiation-derived surrogate isotope in the matrix material.

15. The method of claim 14, wherein removing from the fission products isotopes with half-lives of greater than three days comprises using resins selective for at least one of uranium and strontium.

16. The method of claim 14, wherein encapsulating the at least one Bremsstrahlung-irradiation-derived surrogate isotope in the matrix material comprises synthesizing high-purity silica glass by a sol-gel reaction.

* * * * *